United States Patent [19]

Niemeyer

[11] Patent Number: 4,705,419

[45] Date of Patent: Nov. 10, 1987

[54] MECHANICAL PENCIL WITH AUTOMATIC LEAD ADVANCE

[75] Inventor: Robert Niemeyer, Martinez, Calif.

[73] Assignee: Nicolet Instrument Corporation, Madison, Wis.

[21] Appl. No.: 799,426

[22] Filed: Nov. 19, 1985

[51] Int. Cl.[4] ..... B43K 21/22; B43K 21/20

[52] U.S. Cl. ..... 401/65; 401/53; 401/67; 401/81

[58] Field of Search ..... 401/53, 65–67, 401/93, 94, 81, 80

[56] References Cited

U.S. PATENT DOCUMENTS

| | | | |
|---|---|---|---|
| 2,349,553 | 5/1944 | Juelss | 401/65 |
| 2,484,640 | 10/1949 | Mustard | 401/67 |
| 3,864,046 | 2/1975 | Butka | 401/53 |
| 3,998,558 | 12/1976 | Katz | 401/53 X |
| 4,003,664 | 1/1977 | Butka | 401/67 |
| 4,015,269 | 3/1977 | Edo | 401/65 X |
| 4,149,813 | 4/1979 | Katz et al. | 401/65 |
| 4,172,673 | 10/1979 | Puchein | 401/65 |
| 4,230,413 | 10/1980 | Gartner | 401/65 |
| 4,269,524 | 5/1981 | Hashimoto et al. | 401/65 |
| 4,346,392 | 8/1982 | Isobe et al. | 401/67 X |
| 4,452,544 | 6/1984 | Sumita | 401/53 |
| 4,459,057 | 7/1984 | Hashimoto et al. | 401/53 |
| 4,490,061 | 12/1984 | Katz | 401/53 |
| 4,538,934 | 9/1985 | Brunner | 401/65 X |

FOREIGN PATENT DOCUMENTS

| | | | |
|---|---|---|---|
| 2153400 | 5/1973 | Fed. Rep. of Germany | 401/67 |
| 36508 | 6/1930 | France | 401/67 |
| 925353 | 9/1947 | France | 401/67 |
| 182431 | 2/1936 | Switzerland | 401/67 |

*Primary Examiner*—Steven A. Bratlie

*Attorney, Agent, or Firm*—Isaksen, Lathrop, Esch, Hart, & Clark

[57] ABSTRACT

A mechanical pencil for automatic drawing machines is disclosed which feeds lead segments to the writing surface as the pencil is alternately pressed against and lifted from the writing surface. The pencil includes a housing having a reserve lead containment chamber and a main internal cavity. A collet split into two portions is mounted within the internal cavity beneath an opening between the main cavity and the containment chamber and has outer cone-shaped camming surfaces and first and second axially spaced, cylindrical inner clamping surfaces. A friction tube with an inner bore adapted to frictionally engage a lead segment is mounted beneath the collet and holds a lead segment to support it against the writing surface. When the tip of the friction tube is pressed against a writing surface, the friction tube pushes upwardly on a return spring which in turn drives a collet closing bushing against the bottom surface of the collet portions, driving the outer conical camming surfaces of the collet into contact with an abutment shoulder within the cavity to drive the collet portions together such that the first and second clamping surfaces engage and hold the lead segment. When the pencil is lifted from the writing surface, the pressure on the collet is released and the collet portions separate to allow the lead segment therein to be drawn downwardly by the friction tube.

21 Claims, 4 Drawing Figures

MECHANICAL PENCIL WITH AUTOMATIC LEAD ADVANCE

FIELD OF THE INVENTION

This invention pertains generally to the field of mechanical pencils and particularly to pencils used in plotting machines which have provision for automatic feeding of the lead segments.

BACKGROUND ART

Mechanical pencils having an automatic lead feed arrangement are commonly utilized in automatic drawing or plotting machines. Such mechanical pencils must be capable of feeding the lead segments so that the pencil constantly draws without gaps and without requiring attention from the operator.

A variety of designs for mechanical pencils capable of providing automatic feed have been proposed. Examples of these are shown in U.S. Pat. Nos. 3,998,558, 4,015,269, 4,149,813, 4,172,673, 4,230,413, 4,269,524, 4,346,392, and 4,490,061. The patent to Katz, 4,490,061, shows a mechanical pencil that advances the lead segments as a result of the alternating steps of pressing the pencil tip against the paper and lifting the pencil from the paper. Mechanical pencils which operate in such a manner are thus well adapted to use in automatic plotting machines in which the pencils are repeatedly brought into and out of contact with the surface during the normal drawing operations.

While automatic feeding mechanical pencils suitable for use with plotting machines are known, they typically have been complex in structure and consequently somewhat expensive and prone to mechanical failure. Generally, the more complex the feeding mechanism, the more subject the mechanism is to fouling with dirt or graphite debris and the more critical the requirements for proper alignment of the lead segments to enable correct feeding of the segments in sequence.

SUMMARY OF THE INVENTION

The mechanical pencil of the present invention is particularly adapted for utilization in automated drawing and plotting systems since it achieves automatic feed of lead segments solely as a consequence of the alternate pressing of the pencil to the writing surface and the lifting of the pencil off the writing surface. The advancement of lead segments through the pencil is accomplished with a simplified mechanism having a minimum of moving parts and is less subject to malfunction due to fouling or imprecise mechanical tolerances than conventional pencils using complex feeding mechanisms. The lead segments are nonetheless firmly held as they are fed so that no gaps in the writing occur as the lead wears down. Substantially all of each lead segment is utilized, ensuring that a lead segment will be in writing position whenever the pencil is pressed back to the writing surface.

The structure of the mechanical pencil includes a housing having a containment chamber for reserve lead segments and an opening at the bottom of the chamber through which a lead segment may pass end first, and a main internal cavity below and in communication with the opening in the reserve lead containment chamber. A friction tube is mounted within the internal cavity for axial motion and has an internal bore adapted to have a lead segment inserted therein in frictional engagement with the walls of the bore and with the axis of the bore of the tube aligning with the opening at the bottom of the containment chamber to define the central axis of the pencil. The friction tube extends out from the bottom of the housing and terminates in a lower tip adapted to contact a writing surface. A collet split into two portions is mounted in the internal cavity between the friction tube and the opening from the containment chamber. First and second axially spaced clamping surfaces are formed on the inner surfaces of the collet portions beneath the opening from the containment chamber and are adapted to engage lead segments passed through the opening. The collet also preferably has cone-shaped outer camming surfaces oriented obliquely to the axis of the pencil. The camming surfaces on the collet are adapted to cooperate with a rounded abutment shoulder formed on the walls of the internal cavity such that when the collet is forced upwardly, the abutment surfaces engage the camming surfaces on the collet and drive the collet portions together to cause the clamping surfaces to engage a lead segment. Means are provided between the friction tube and the collet to urge the collet portions axially upwardly when the tip of the friction tube is in contact with the writing surface and is pushed upwardly thereby. This means may take the form of a return spring and a cylindrical collet closing bushing both mounted within the internal cavity partially around the friction tube such that when the friction tube moves upwardly, the return spring is compressed against the collet closing bushing which in turn is pushed upwardly against the collet portions to drive them upwardly.

An initial lead segment is inserted into the bore of the friction tube and held therein by the engagement of the bore walls with the lead segment. The friction tube supports the tip of the lead segment against lateral forces on the lead segment during writing. When the friction tube is pressed against the surface, it rides upwardly, pressing the return spring upwardly against the collet closing bushing which in turn pushes the collet portions upwardly so that the outer camming surfaces of the collet engage against the abutment shoulder and thus cause the clamping surfaces of the collet to engage and hold the lead segment within the collet. As the lead wears down, the friction tube rides up within the internal cavity of the housing. When the pencil is lifted from the writing surface, the friction tube is forced down by the return spring and tends to draw the lead segment with it; in doing so, the spring pressure on the collet closing bushing is released and it drops down with the friction tube, allowing the portions of the collet to drop down and spread apart, releasing the pressure from the collet clamping surfaces against the lead segment. The cycle described above is repeated until the writing lead segment is sufficiently short that its upper end is below the first of the clamping surfaces in the collet, allowing the next lead segment within the storage container to drop down, end first, through the bottom opening and into the top of the collet.

Because the collet has first and second distinct clamping surfaces, which are separated by an open space circumscribed by spacer surfaces in the collet of larger diameter than the clamping surfaces, the collet may grasp, independently, both the lead segment presently pressing against the writing surface and the next lead segment to be fed. In particular, the provision of the first and second clamping surfaces allows some tolerance in the positioning of the lead segment being fed to the clamping surfaces in that a misalignment of the new lead segment with the precise center of the first clamping surface will not interfere with the engagement of the second clamping surface with the lead segment which is being held for writing on the writing surface. However, when the next lead segment is held by both the first and second clamping surfaces, it is precisely aligned with the central axis of the pencil and precisely aligned with the preceding lead segment held within the bore of the friction tube. The next lead segment will be fed precisely to the center of the bore of the friction tube as the friction tube rides up during the wearing of the lead segment held therein.

Further objects, features, and advantages of the invention will be apparent from the following detailed description when taken in conjunction with the accompanying drawings.

DESCRIPTION OF THE PREFERRED EMBODIMENT

Figure 1:
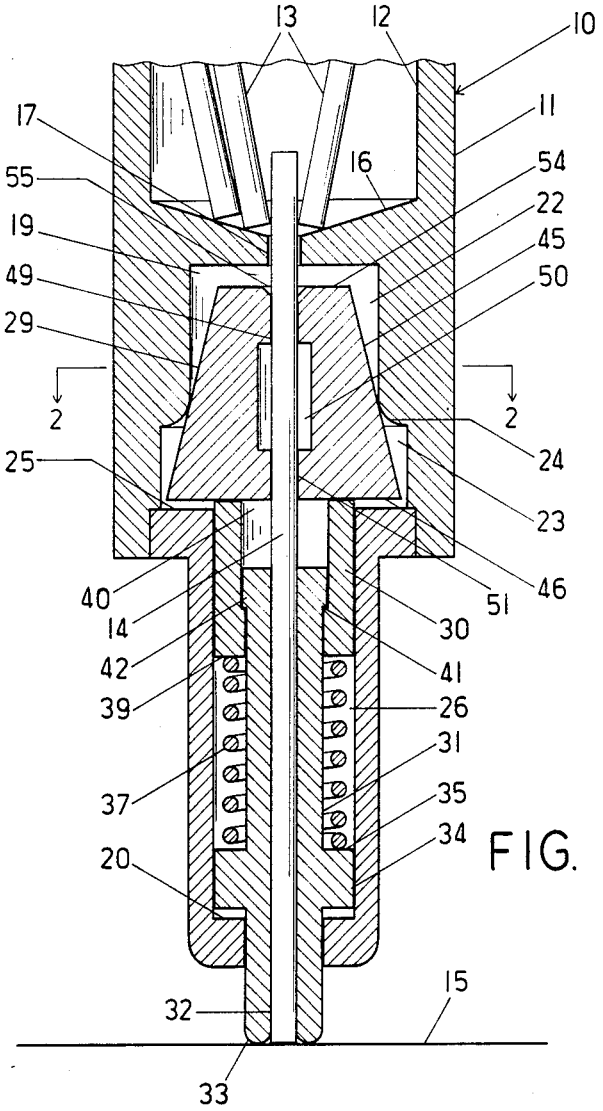
FIG. 1 is a cross-sectional view of a mechanical pencil in accordance with the invention taken across a diameter of the pencil, the pencil being symmetrical about its central axis.
Figure 2:
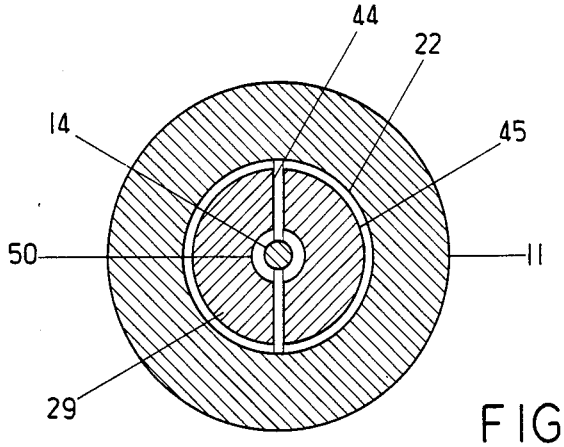
FIG. 2 is a cross-sectional view through the pencil of FIG. 1 taken generally along the lines 2—2 of FIG. 1.

With reference to the drawings, a cross-sectional view through a mechanical pencil with automatic lead advance in accordance with the invention is shown generally at 10 in FIG. 1. The pencil 10 has a main housing 11, preferably cylindrical in exterior shape, which has an upper containment chamber 12 for storing lead segments 13. The upper portion of the housing 11 defining the top of the chamber 12 is not shown in FIG. 1, it being understood that the pencil has a suitable cap or end plug to close off the chamber 12 after the lead segments 13 are emplaced therein. It is also understood that in the preferred intended use of the pencil 10 in automatic drawing or plotting machines, the housing 11 would be mounted to a mechanical linkage which would serve to move the pencil in a desired set of motions about the writing surface 15 and press the pencil toward the surface 15 or lift it away therefrom, as necessary. Of course, it may also be noted that the pencil 10 may be utilized in other than drafting machines where appropriate, for example as a hand-held pencil. However, the pencil 10 is particularly adapted to mechanical drafting systems wherein the pencil is continuously held in a substantially upright position and is periodically lifted from the writing surface.

The lead containment chamber 12 has a downwardly sloping, preferably conically shaped bottom surface 16 with a central opening 17 therein which is sized somewhat larger than the diameter of the lead segments 13. As illustrated in FIG. 1, the lead segment 14 which is in contact with the writing surface 15 has passed down through the opening 17 and, for purposes of illustration, is shown as extending upwardly into the chamber 12 beyond the opening 17. The dimensions of the reserve lead chamber 12 are such that the reserve lead segments 13 stand substantially upright within the container and have one end thereof which ride down the bottom surface 16 toward the opening 17. When the one lead segment 14 which is in contact with the writing surface has worn away sufficiently that its upper end is below the opening 17, one of the segments 13 will fall, end first, into the opening 17. The action of gravity on the segments 13 and the drawing motions of the pencil 10 are sufficient to agitate the lead segments 13 and cause the segments to be sequentially passed into the hole 17 without any additional feeding mechanism.

The housing 11 also has a main internal cavity 19 which extends beneath the feed opening 17 and terminates at a flat bottom surface 20. The main internal cavity 19 has an uppermost cavity portion with substantially cylindrical walls 22, an adjacent cylindrical cavity portion having cylindrical walls 23 of a diameter greater than that of the cavity walls 22, and a rounded abutment shoulder surface 24 which joins the surfaces 22 and 23. Preferably, the rounded abutment shoulder 24 extends entirely around the circumference of the internal cavity 19 although, as noted below, the abutment surfaces may be formed only over a portion of the cavity circumference. A flat base shoulder 25 extends inwardly from the cylindrical surface 23 to an inner cylindrical bore 26 portion of the cavity 19 which extends downwardly to the bottom surface 20. Preferably, the internal cavity 19 defined by the surfaces 22, 23, 24, 25, 26 and 20 is symmetrical about a central axis through the middle of the lead segment 14.

Disposed within the main internal cavity 19 are a split collet 29, a collet closing bushing 30, and a friction tube 31. The friction tube 31 has an internal bore 32 in which the lead segment 14 is held by friction with the walls of the bore. The bore 32 aligns with the opening 17 along the central axis of the pencil and may be considered to define the central axis. A portion of the friction tube 31 extends out of the housing 11 and terminates at a tip end 33 which contacts the writing surface 15 when the pencil 10 is writing. The friction tube 31 also has an outwardly extending flange 34 formed intermediate the ends of the friction tube which has an upper shoulder surface 35. A compression return spring 37 is mounted in the space between the surface of the bore 26 of the housing and the outer surface of the friction tube 31 in the space between the shoulder 35 and the bottom surface 39 of the collet closing bushing 30. The bushing 30 has an outer cylindrical surface matching the cylindrical inner bore 26, allowing the bushing to slide up and down within the bore 26. The bushing 30 also has an inner cylindrical bore 40 within which the friction tube 31 can slide relative to the bushing. The bushing 30 has an inwardly extending shoulder 41 in its bore 40 which is adapted to engage an outwardly extending flange 42 on the top end of the friction tube to define the downward-most limit of travel of the friction tube with respect to the bushing.

The collet 29 serves to align newly received reserve lead segments 13 with the previously emplaced writing lead segment 14 and to firmly hold the lead segment 14 during writing against the force applied to the lead segment 14 by contact with the writing surface 15. As illustrated in FIG. 1, the collet 29 is preferably formed having the exterior shape of a frustum of a cone split at a line 44 into two substantially identical portions. The outer conical surfaces 45 of the collet portions are disposed at an oblique angle with the central axis of the pencil. The surfaces 45 serve as camming surfaces which are positioned to engage the rounded shoulders 24 as the collet closing bushing 30 presses upwardly against the flat bottom surface 46 of the collet, causing the split collet portions to be driven toward each other and toward the central axis.

The collet 29 has interior surfaces including first cylindrical clamping surfaces 49 on both portions of the collet near its top end which are semi-cylindrical in shape and adapted to match the outer surface of the lead segments 13 and 14. The collet portions also have spacer surfaces 50, preferably cylindrical and of a larger diameter than the first clamping surfaces 49, and second clamping surfaces 51 which are again semi-cylindrical in shape and adapted to match the outer surface of the lead segments 13 and 14. The second clamping surfaces 51 are distinct from and spaced downwardly from the first clamping surfaces 49, separated therefrom by the spacer surfaces 50, and are located preferably at the bottom of the collet. The surfaces 49, 50 and 51 are formed to surround the central axis of the pencil.

The collet 29, collet closing bushing 30, and the friction tube 31 are each capable of limited movement within the internal cavity 19 in the axial direction, that is, up and down along the central axis of the pencil. The collet 29 is movable between a position in which its bottom surface 46 rests on the base shoulder 25, as illustrated in FIG. 4, and in which the first clamping surface 49 and second clamping surface 51 are spaced away from the lead segment within the collet, to a position as shown in FIG. 1 or 3 in which the collet has reached its upper limit of travel and the camming surfaces 45 are firmly in contact with the shoulder abutment 23, driving the first and second clamping surfaces 49 and 51 into firm engagement with the lead segments within the collet.

Figure 3:
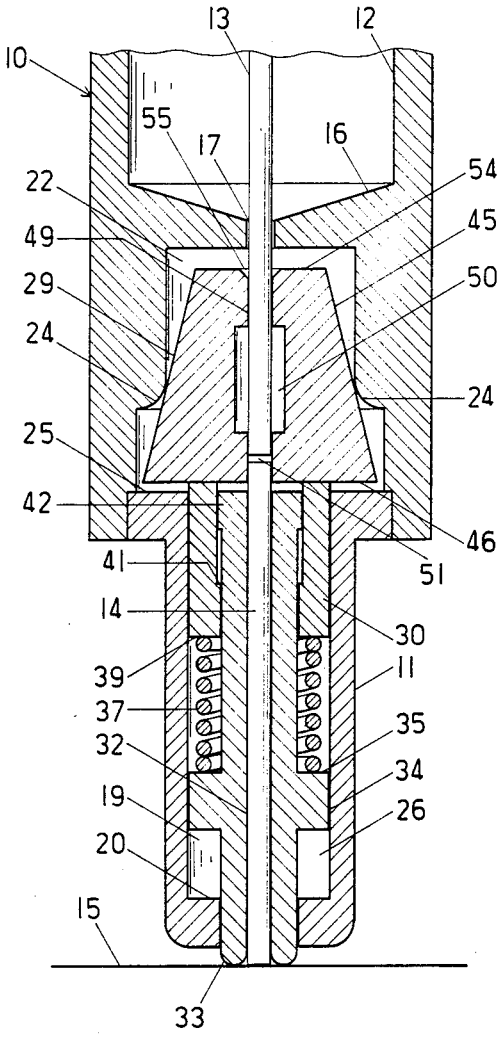
FIG. 3 is a cross-sectional view as in FIG. 1 with the pencil pressed against the writing surface and with the friction tube, holding a lead segment for writing, moved to the upper limit of its travel.
Figure 4:
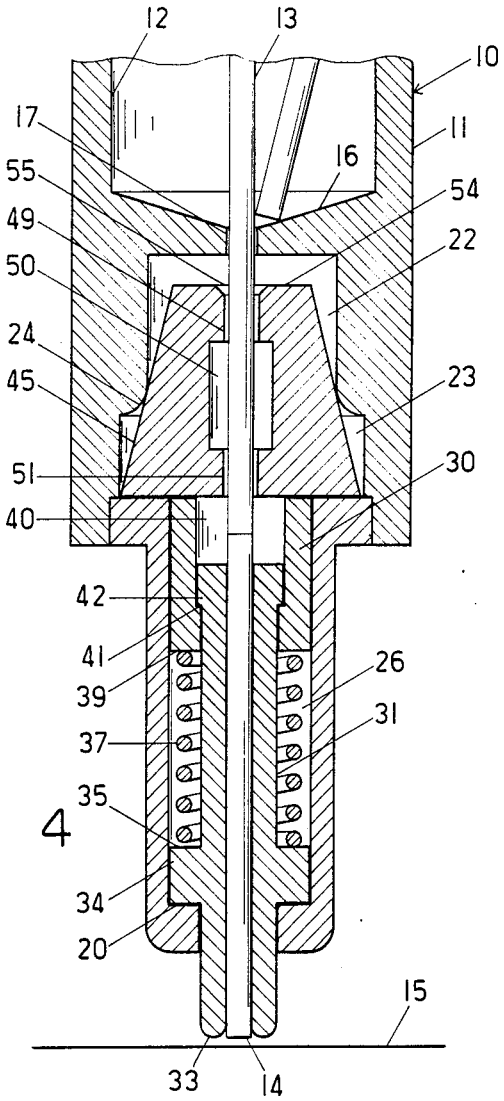
FIG. 4 is a cross-sectional view as in FIG. 1 showing the position of the elements within the pencil when the pencil is lifted from the writing surface.

The friction tube 31 is movable between a fully extended position, as shown in FIG. 4, in which its tip 33 is lifted off the writing surface 15 and in which the bottom of the flange 34 on the friction tube is in contact with the bottom surface 20 of the main cavity 19 to prevent further downward movement of the friction tube, and a fully withdrawn position, as shown in FIG. 3, in which the top of the friction tube 31 is near to or in contact with the bottom surface 36 of the collet and the spring 37 is substantially fully compressed.

The collet closing bushing 30 is resiliently urged upwardly by the spring 37 so as to be normally in contact with the bottom surface 46 of the collet 29. When the pencil is lifted from the writing surface 15, as illustrated in FIG. 4, the collet closing bushing 30 is at its lowermost limit of travel with its top surface substantially at the same level as the base shoulder 25 on which the collet portions rest. Once the tip 33 of the friction tube contacts the writing surface and is pressed upwardly thereby, the collet closing bushing 30 moves to its uppermost position as illustrated in FIGS. 1 and 3—its uppermost limit of movement—in which the collet 29 is firmly engaged with the abutment surfaces within the cavity 19.

From the foregoing it will be noted that the friction tube slides upwardly within the main cavity in the pencil housing 11 without interference as the lead segment 14 wears down so that the tip 33 of the friction tube is always at the same level as the writing end of the lead segment 14. The writing lead segment 14 must be maintained in firm contact against the writing surface 15 and must be prevented from sliding upwardly with respect to the friction tube. To hold the writing segment 14 in place, either the writing segment 14 itself or the next reserve lead segment 13 directly above and in engagement with the writing segment 14 (as illustrated in FIG. 4) must be firmly held by the clamping surfaces of the collet 29. The return spring 37 and the collet closing bushing cooperate to provide a means for urging the collet upwardly to force the collet camming surfaces into engagement with the abutment surfaces within the internal cavity to drive the collet portions together and firmly engage the first and second clamping surfaces within the collet onto the lead segments within the collet.

As illustrated in FIG. 4, when the tip 33 of the friction tube is out of contact with the writing surface 15, the collet closing bushing 30 is at its uppermost limit of travel with respect to the friction tube and does not exert a force on the collet, thereby allowing the collet to relax and part the clamping surfaces 49 and 51 from the lead segment within the collet. The bushing 30 is firmly maintained at its limit of travel by the action of the compression spring 37 which is always in compression. As soon as the tip 33 of the friction tube comes into contact with the writing surface 15, the friction tube and the writing lead segment 14 held within it will deflect upwardly slightly, causing the bushing 30 to move upwardly which lifts the two portions of the collet upwardly and into engagement with the abutment surfaces 24. Upon engagement of the collet clamping surfaces 49 and 51 with the lead segment, further upward motion of the friction tube and the writing lead segment 14 is halted, resulting in the relative position of the parts which is illustrated in FIG. 1.

As the lead wears down and the friction tube moves upwardly within the housing, the length of the segment 14 of lead that is writing decreases. When the pencil is next lifted off of the writing surface, the friction tube drops downwardly to its position shown in FIG. 4, carrying the writing lead segment downwardly with it. When the length of the writing lead segment 14 is sufficiently short that the top of the lead segment drops below the opening 17, a reserve lead segment will drop end first into the opening 17. Eventually, the upper tip of the writing lead segment 14 will drop below the upper surface 54 of the collet. A small conically shaped depression 55 is formed in the top surface 54 of each of the collet portions surrounding the position of the upper clamping surface 49. The conical depression 54 serves to guide the end of the next reserve lead segment 13 into proper position between the upper clamping surfaces 49. As the cycle of lifting and pressing of the pen repeats, and the writing lead segment shortens, more and more of the reserve lead segment will descend into the collet 29. It is a particular advantage of the collet construction of the present invention that the subsequent reserve lead segment need not be precisely aligned with the axis of the pencil and, in fact, may be slightly misaligned without affecting the proper grasping by the second clamping surfaces of the writing lead segment 14. For example, a reserve lead segment may extend into the collet at a slight oblique angle to the central axis of the pencil. In a situation such just described, the first clamping surfaces 49 would not necessarily firmly grasp the reserve lead segment. However, the lower clamping surfaces 51 would still be driven inwardly by the action of the collet camming surfaces 45 engaging against the abutment surfaces 24 at an axial position between the spaced clamping surfaces 49 and 51, and would very firmly grasp and hold the writing lead segment 14. Consequently, the two separate clamping surfaces on the collet portions 29 perform separately the function of aligning the reserve lead segment 13 with the central axis of the pencil and the function of firmly grasping the writing lead segment to hold it against upward movement. During the time that the pencil is lifted off of the writing surface 15, as illustrated in FIG. 4, the reserve lead segment drops freely downwardly until its bottom surface comes into contact with the top surface of the writing lead segment 14. Eventually, as the writing lead segment wears down, the lower end of the reserve lead segment will reach the second clamping surfaces 51, as illustrated in FIG. 3, and the action of the clamping surfaces 49 and 51 together acting upon the reserve lead segment 13 will cause the lead segment to become aligned with the central axis of the pencil and in direct alignment with the writing lead segment. Thereafter, as the upper end of the writing lead segment 14 drops below the collet, as illustrated in FIG. 4, the lower end of the reserve lead segment will be in engagement with it and the reserve segment will be firmly clamped by the collet upon engagement of the friction tube tip 33 with the writing surface to prevent upward movement of either the reserve lead segment 13 or the writing lead segment 14.

The various components of the pencil 10 may be formed of any suitable materials, for example, stainless steel, brass, aluminum, etc. Because of the simplicity and lack of structures that are subject to wear within the device, softer materials, e.g., plastics, may also be utilized for some applications.

Although the collet 29 has been illustrated in its preferred structure as a frustum of a cone split in two along a diameter, it is apparent that other structures for the collet may be utilized. For example, the collet may be formed substantially rectangular in cross-section with the camming surfaces 45 being flat surfaces on the opposite sides of the collet. In effect, the collet would have the form of a trapezoidal solid. Appropriate mating abutment surfaces 24 would be formed to properly engage the camming surfaces on the collet to allow the collet its necessary range of motion up and down while causing inward pressing of the collet as a result of the camming engagement with the abutment surfaces. Other suitable means for urging the collet portions inwardly toward the axis of the pencil when the friction tube is in contact with the writing surface may also be utilized.

It is understood that the invention is not confined to the particular construction and arrangement of parts herein illustrated and described, but embraces such modified forms thereof as come within the scope of the following claims.

What is claimed is:

1. A mechanical pencil having automatic advancement of lead segments comprising:

(a) a housing having a containment chamber for reserve lead segments, an opening at the bottom of the chamber through which a lead sigment may pass end first, and a main internal cavity below and in communication with the opening in the reserve lead containment chamber;

(b) a friction tube mounted within the internal cavity for axial motion therein and having an internal bore adapted to have a lead segment inserted therein in frictional engagement with the walls of the bore, the axis of the bore of the tube aligning with the opening at the bottom of the containment chamber to define the central axis of the pencil, the friction tube terminating in a lower tip adapted to contact a writing surface;

(c) a collet having plural portions and first and second distinct axially spaced clamping surfaces on the portions positioned beneath the opening from the containment chamber and adapted to selectively engage lead segments passed through he opening, the collet portions having outer camming surfaces oriented obliquely to the axis of the pencil and being movable axially within the internal cavity;

(d) abutment means on the walls of the internal cavity of the housing for engaging the camming surfaces on the collet portions at an axial position between the axially spaced clamping surfaces when the collet portions move axially upwardly within the internal cavity to drive the collet portions inwardly to cause the clamping surfaces thereof to engage a lead segment therebetween; and (e) means engaged between the friction tube and collet for urging the collet portions axially upward to bring the camming surfaces thereon into engagement with the abutment means when the tip of the friction tube is in contact with the writing surface and is pushed upwardly thereby, whereby a lead segment within the collet is engaged and held by the clamping surfaces.

2. The mechanical pencil of claim 1 wherein the abutment means comprises a rounded abutment shoulder extending from an upper cylindrical portion of the main interior cavity of a first diameter to a lower second cylindrical portion of the main interior cavity of a larger diameter.

3. The mechanical pencil of claim 2 wherein the outer camming surfaces of the collet have the shape of a frustum of a cone and wherein the collet is formed of two substantially identical portions.

4. The mechanical pencil of claim 1 wherein the means engaged between the friction tube and collet include a return spring mounted in compression around a portion of the friction tube and engaged thereto to be compressed upwardly when the friction tube is in contact with the writing surface and is pushed upwardly thereby and a collet closing bushing having an interior bore and mounted to the friction tube to slide axially thereabout and wherein the spring is mounted in contact with the bottom of the collet closing bushing to urge the same upwardly, and wherein the top of the collet closing bushing terminates in position to engage the bottom surfaces of the collet portions to push the same upwardly when the tip of the friction tube is in contact with the writing surface and the friction tube moves upwardly, compressing the return spring against the collet closing bushing.

5. The mechanical pencil of claim 4 wherein the friction tube has a substantially cylindrical outer periphery and a lower flange extending therefrom over a portion of the periphery thereof and having an outer cylindrical wall adapted to engage with an inner cylindrical wall within a portion of the main internal cavity to slide axially therein and also having an upper shoulder to which the return spring is engaged, and wherein the collet closing bushing has substantially cylindrical inner and outer surfaces and has the outer surface thereof in sliding engagement with the cylindrical interior wall of the portion of the main internal cavity and also has an inwardly extending shoulder within its inner cylindrical bore which is adapted to engage an upper flange on the friction tube which extends outwardly from the top end of the friction tube to define the downward-most limit of travel of the friction tube with respect to the collet closing bushing.

6. The mechanical pencil of claim 1 wherein the collet is formed in the shape of a frustum of a cone having conical outer surfaces and flat bottom and top surfaces and is split into two substantially equal portions, and wherein the two portions of the collet have first and second clamping surfaces which are semi-cylindrical and which surround the central axis of the mechanical pencil and which are spaced axially from one another by an internal cylindrical spacer surface within the portions of the collet which has a diameter larger than the diameter of the cylindrical clamping surfaces.

7. The mechanical pencil of claim 1 wherein the lead containment chamber has a conically shaped bottom surface surrounding and declining toward the opening at the bottom of the chamber through which a lead segment may pass, and wherein the collet portions each have a conically shaped top surface portion surrounding and descending toward the first clamping surfaces, the conical surfaces serving to guide the ends of the lead segments to the centers of the conical surfaces.

8. The mechanical pencil of claim 5 wherein the lower flange on the friction tube has a downwardly facing lower surface and wherein the internal cavity within the housing has a flat surface defining the bottom of the main internal cavity and wherein the lower surface on the lower friction tube flange engages the bottom surface of the main internal cavity to limit the downward extent of travel of the friction tube, a portion of the friction tube extending downwardly from the lower flange through an opening in the bottom surface of the main interior cavity to the lower tip of the friction tube.

9. A mechanical pencil having automatic advancement of lead segments comprising:

(a) a housing having a containment chamber for reserve lead segments, an opening at the bottom of the chamber through which a lead segment may pass end first, and a main internal cavity below and in communication with the opening in the reserve lead containment chamber;

(b) a friction tube mounted within the internal cavity for axial motion therein and having an internal bore adapted to have a lead segment inserted therein in frictional engagement with the walls of the bore, the axis of the bore of the tube aligning with the opening at the bottom of the containment chamber to define the central axis of the pencil, the friction tube terminating in a lower tip adapted to contact a writing surface;

(c) a collet having plural portions mounted within the internal cavity between the opening from the containment chamber and the friction tube, the collet having a top and a bottom, the collet portions having only first and second axially spaced, semi-cylindrical inner clamping surfaces which are positioned beneath the opening from the containment chamber around the central axis of the pencil and are adapted to selectively engage lead segments passed through the opening, the first and second clamping surfaces separated by cylindrical spacer surfaces of larger diameter than the diameter of the clamping surfaces, with the first clamping surface at the top of the collet and the second clamping surface at the bottom of the collet; and (d) means for urging the collet portions inwardly toward the axis of the pencil to cause the clamping surfaces to engage a lead segment therebetween when the tip of the friction tube is in contact with the writing surface and is pushed upwardly thereby, whereby a lead segment within the collet is engaged and held by the clamping surfaces.

10. The mechanical pencil of claim 9 wherein the collet portions are movable axially in the internal cavity and the means for urging the collet portions inwardly include:

(1) outer camming surfaces on the collet portions which are oriented obliquely to the axis of the pencil;

(2) abutment means on the walls of the internal cavity of the housing for engaging the camming surfaces on the collet portions when the collet portions move axially upwardly within the internal cavity to drive the collet portions inwardly to cause the clamping surfaces thereof to engage a lead segment therebetween; and (3) means engaged between the friction tube and collet for urging the collet portions axially upward to bring the camming surfaces thereon into engagement with the abutment means when the tip of the friction tube is in contact with the writing surface and is pushed upwardly thereby, whereby a segment within the collet is engaged and held by the clamping surfaces.

11. The mechanical pencil of claim 10 wherein the abutment means comprises a rounded abutment shoulder extending from an upper cylindrical portion of the main interior cavity of a first diameter to a lower second cylindrical portion of the main interior cavity of a larger diameter.

12. The mechanical pencil of claim 11 wherein the outer camming surfaces of the collet have the shape of a frustum of a cone and wherein the collet is formed of two substantially identical portions.

13. The mechanical pencil of claim 10 wherein the means engaged between the friction tube and collet include a return spring mounted in compression around a portion of the friction tube and engaged thereto to be compressed upwardly when the friction tube is in contact with the writing surface and is pushed upwardly thereby and a collet closing bushing having an interior bore and mounted to the friction tube to slide axially thereabout and wherein the spring is mounted in contact with the bottom of the collet closing bushing to urge the same upwardly and wherein the top of the collet closing bushing terminates in position to engage the bottom surfaces of the collet portions to push the same upwardly, when the tip of the friction tube is in contact with the writing surface and the friction tube moves upwardly, compressing the return spring against the collet closing bushing.

14. The mechanical pencil of claim 13 wherein the friction tube has a substantially cylindrical outer periphery and a lower flange extending therefrom over a portion of the periphery thereof and having an outer cylindrical wall adapted to engage with an inner cylindrical wall within a portion of the main internal cavity to slide axially therein and also having an upper shoulder to which the return spring is engaged, and wherein the collet closing bushing has substantially cylindrical inner and outer surfaces and has the outer surface thereof in sliding engagement with the cylindrical interior wall of the portion of the main internal cavity and also has an inwardly extending shoulder within its inner cylindrical bore which is adapted to engage an upper flange on the friction tube which extends outwardly from the top end of the friction tube to define the downward-most limit of travel of the friction tube with respect to the collet closing bushing.

15. The mechanical pencil of claim 9 wherein the collet is formed in the shape of a frustum of a cone having conical outer surfaces and flat bottom and top surfaces and is split into two substantially equal portions.

16. The mechanical pencil of claim 9 wherein the lead containment chamber has a conically shaped bottom surface surrounding and declining toward the opening at the bottom of the chamber through which a lead segment may pass, and wherein the collet portions each have a conically shaped top surface portion surrounding and descending toward the first clamping surfaces, the conical surfaces serving to guide the ends of the lead segments to the centers of the conical surfaces.

17. The mechanical pencil of claim 14 wherein the lower flange on the friction tube has a downwardly facing lower surface and wherein the internal cavity within the housing has a flat surface defining the bottom of the main internal cavity and wherein the lower surface on the lower friction tube flange engages the bottom surface of the main internal cavity to limit the downward extent of travel of the friction tube, a portion of the friction tube extending downwardly from the lower flange through an opening in the bottom surface of the main interior cavity to the lower tip of the friction tube.

18. A mechanical pencil having automatic advancement of lead segments comprising:

(a) a housing having a containment chamber for reserve lead segments, an opening at the bottom of the chamber through which a lead segment may pass end first, and a main internal cavity below and in communiction with the opening in the reserve lead containment chamber;

(b) a friction tube mounted within the internal cavity for axial motion therein and having an internal bore adapted to have a lead segment inserted therein in frictional engagement with the walls of the bore, the axis of the bore of the tube aligning with the opening at the bottom of the containment chamber to define the central axis of the pencil, the friction tube terminating in a lower tip adapted to contact a writing surface;

(c) a collet in the form of a frustum of a cone having a top and a bottom and split into two substantially equal portions, the curved outer surfaces of the collet defining camming surfaces oriented obliquely to the axis of the pencil, the collet portions each having first and second distinct axially spaced inner clamping surfaces which are positioned beneath the opening from the containment chamber around the central axis of the pencil and are adapted to selectively engage lead segments passed through the opening, with the first clamping surfaces at the top of the collet and the second clamping surfaces at the bottom of the collet, the collet movable axially within the internal cavity;

(d) a rounded abutment shoulder formed on the internal cavity of the housing surrounding the periphery of the collet and positioned to engage the camming surfaces on the outside of the collet portions at an axial position between the axially spaced clamping surfaces when the collet portions move axially upwardly within the internal cavity to drive the collet portions inwardly to cause the clamping surfaces thereof to engage against a lead sebment therebetween;

(e) a collet closing bushing having cylindrical inner and outer surfaces mounted partially surrounding the friction tube and within the internal cavity to move axially therein and with respect to the friction tube and having a top surface positioned to engage the bottom surfaces of the collet portions; and (f) a compression return spring mounted about a portion of the friction tube and engaged at its bottom to a lower flange on the friction tube such that the spring will be compressed upwardly when the friction tube tip is in contact with the writing surface and is pressed upwardly thereby, and wherein the return spring is engaged at it top to the bottom of the collet closing bushing such that when the top of the friction tube is in contact with the writing surface and is pushed upwardly thereby, the return spring compresses against the collet closing bushing to drive the same against the bottom surfaces of the collet portions and thereby move them upwardly such that their camming surfaces engage the abutment shoulder surfaces and the collet portions are driven inwardly to engage and hold a lead segment within the collet.

19. The mechanical pencil of claim 18 wherein the two portions of the collet have first and second clamping surfaces which are semi-cylindrical and which surround the central axis of the mechanical pencil and which are spaced axially from one another by an internal cylindrical spacer surface within the portions of the collet which has a diameter larger than the diameter of the cylindrical clamping surfaces.

20. The mechanical pencil of claim 18 wherein the lead containment chamber has a conically shaped bottom surface surrounding and declining toward the opening at the bottom of the chamber through which a lead segment may pass, and wherein the collet portions each have a conically shaped top surface portion surrounding and descending toward the first clamping surfaces, the conical surfaces serving to guide the ends of the lead segments to the centers of the conical surfaces.

21. The mechanical pencil of claim 19 wherein the lower flange on the friction tube has a downwardly facing lower surface and wherein the internal cavity within the housing has a flat surface defining the bottom of the main internal cavity and wherein the lower surface on the lower friction tube flange engages the bottom surface of the main internal cavity to limit the downward extent of travel of the friction tube, a portion of the friction tube extending downwardly from the lower flange through an opening in the bottom surface of the main interior cavity to the lower tip of the friction tube.

* * * * *